United States Patent [19]

Perrin

[11] Patent Number: 4,862,562

[45] Date of Patent: Sep. 5, 1989

[54] DEVICE FOR THE ADJUSTABLE FASTENING OF A STRAP, ESPECIALLY OF A WRISTWATCH

[75] Inventor: Alain D. Perrin, Rueil Malmaison, France

[73] Assignee: Cartier International B.V., Amsterdam-C, Netherlands

[21] Appl. No.: 182,663

[22] Filed: Apr. 18, 1988

[30] Foreign Application Priority Data

Apr. 17, 1987 [FR] France ..... 87 05512

[51] Int. Cl.[4] ..... A44C 5/24

[52] U.S. Cl. ..... 24/71 J; 24/265 WS

[58] Field of Search ..... 24/71 J, 70 J, 265 WS, 24/16 R, 17 A, 17 AP, 170, 200, 585, 336

[56] References Cited

U.S. PATENT DOCUMENTS

| | | | |
|---|---|---|---|
| 2,446,065 | 7/1948 | Starke | 24/265 WS |
| 3,066,374 | 12/1962 | Garson | 24/200 |
| 3,478,537 | 11/1969 | Golberine et al. | 24/265 WS |
| 4,446,604 | 5/1984 | Sen-yi | 24/71 J |
| 4,539,736 | 9/1985 | Yokosuka | 24/265 WS |
| 4,750,241 | 6/1988 | Powell | 24/16 R |

FOREIGN PATENT DOCUMENTS

| | | | |
|---|---|---|---|
| 2442605 | 6/1980 | France . | |
| 131643 | 2/1929 | Switzerland | 24/265 WS |
| 608702 | 1/1979 | Switzerland . | |

*Primary Examiner*—Victor N. Sakran

*Attorney, Agent, or Firm*—Cushman, Darby & Cushman

[57] ABSTRACT

A device for fastening a strap to a buckle, in particular a leather strap to a self-extending buckle of a wristwatch comprises spindle around which a band making up the strap is coiled, and a support holding a first part of the band in place coiled around the spindle. In addition, the device includes two posiitoning devices of one piece with the support, located one on each side of the band and whose ends, separated one from the other by a distance smaller than the width of the band, are located at a sufficient distance from the spindle toward the strap so that the edges of the second part of the band coiled around the spindle and located on the side opposite to the first part bearing on the support, may, by twisting the band along lines parallel to its length, be inserted underneath the positioning devices in order to determine the useful length of the strap.

5 Claims, 2 Drawing Sheets

DEVICE FOR THE ADJUSTABLE FASTENING OF A STRAP, ESPECIALLY OF A WRISTWATCH

The present invention concerns a new adjustable device for attaching a strap, especially a wristwatch.

Use of buckles termed "self-extending" for wristwatches is currently well known; these buckles consist of two metallic pieces hinged together to one of their ends, while the other end of each piece is attached to one end of the component parts of the strap, which are most often comprised of leather bands.

The advantage of these devices is that they are particularly pleasing esthetically and that they prevent the watch from falling off when the strap buckle is unfastened, because this opening performs the sole function of increasing substantially the circumference of the strap, which can thus be slid over the hand.

However, these straps with self-extending buckles have the disadvantage that it is necessary to adjust the leather bands making up the watchband itself so that each band is of a length which corresponds to the wrist circumference of the watch user. The present invention concerns a device which allows the simple, effective, and rapid adjustment of the length of a leather piece of the watchband, so that it corresponds to the circumference of the wrist of the user.

The device according to the invention is particularly suited to the adjustable fastening of a leather strap to a self-extending buckle, but it may also be used with other types of buckles.

The object of the present invention is a device for fastening a strap onto a buckle, in particular a leather strap onto a self-extending buckle of a wristwatch, of the type comprised of a spindle around which is coiled the band comprising the strap, and of a support holding a first portion of the band coiled around the spindle, characterized by the fact that, in addition, it incorporates two positioning devices making up one piece with the support, located one on each side of the band and whose ends, separated one from the other by a distance smaller than the width of the band, are located at a sufficient distance from the spindle toward the strap so that the edges of the second part of the band, coiled around the spindle and positioned on the opposite side from the first part bearing on the support, may, by a twisting of the band along lines parallel to its length, be attached underneath the positioning devices in order to determine the useful length of the strap.

In accordance with the invention, and although the description of the strap specifies that it is made of a leather band, it is evident that this strap may be made of any material having similar characteristics.

In a preferred embodiment of the invention, the device according to the invention contains a support comprised of a relatively thin metallic plate, folded back at a right angle to its ends in order to form two wings which are separated one from the other by a distance slightly greater than the width of the band making up the strap; the spindle is fastened between these folded wings in such a way that a distance slightly greater than the thickness of the band is maintained between the spindle and the plate, and the wings folded back at a right angle to the plate are themselves extended toward the strap by means of the positioning devices which are offset inward at a sufficient distance from the spindle so that the band comprising the strap may be attached underneath these positioning devices.

Because of the invention, the leather band making up the strap may be folded back on itself at any place whatsoever along its length; the band will thus be held simply and effectively in that position by the device just described, without necessitating holes punched in the strap.

In a preferred embodiment of the invention, the free end of a piece joined to the self-extending buckle is made, in the closed position, to cover and hide the device according to the invention, which is attached to the free end of the other piece of the self-extending buckle in such a way that the buckle preserves its esthetic appearance.

In order to make the invention better understood, there is now described, by way of illustration and without limiting the invention to this description, an embodiment to be taken as an example which is shown in the attached drawings. In these drawings.

Figure 1:
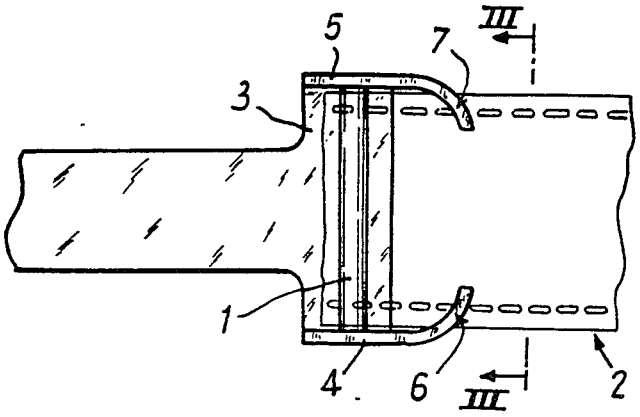
FIG. 1 is a front elevational view of the device according to the invention.
Figure 2:
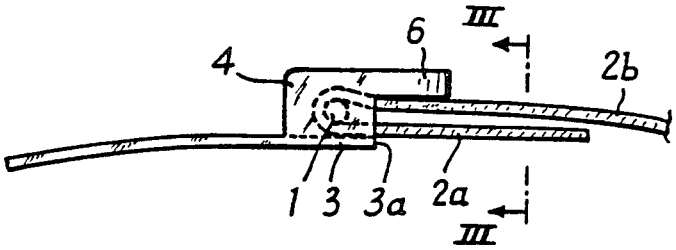
FIG. 2 is a top plan view of the device shown in FIG. 1.
Figure 3:
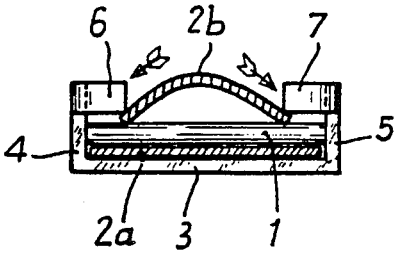
Figure 4:
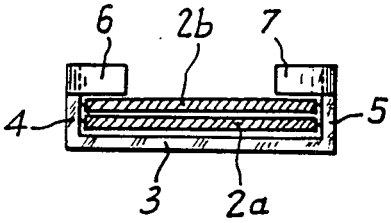
Figure 5:
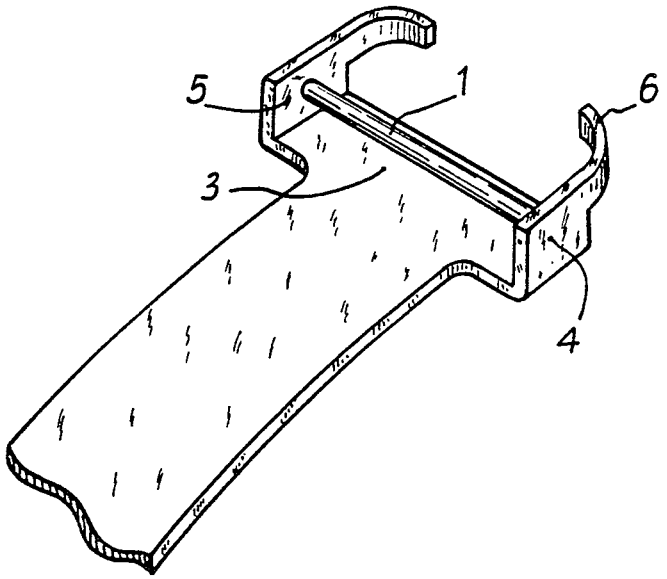

FIGS. 3 cross sections along line III—III of FIGS. 1 and 2;

FIG. 5 a perspective view of the device in FIGS. 1–4; and

Figure 6:
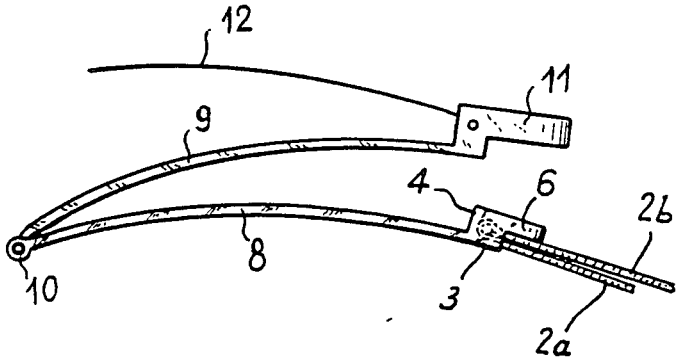

FIG. 6 a top plan view of a self-extending buckle equipped with the device shown in FIGS. 1–5.

The fastening device is shown in heavy lines in FIG. 1, and the outlines of the leather band making up the strap itself are shown in fine lines.

FIGS. 1–3 represent the metallic spindle (1) around which the the leather band (2) of the strap is coiled in order to form parts (2*a* and 2*b*).

FIGS. 1–4 also show the support plate (3) whose ends (4 and 5) are folded back at a right angle to form wings which support the spindle (1) which may be attached, for example by soldering.

In accordance with the invention, the distance separating the spindle (1) from the support plate (3) is slightly greater than the thickness of the leather band (2), and, as shown in FIGS. 1 and 2, the support plate (3) is extended sufficiently to the right up to 3*a* in relation to the spindle (1), so that it holds the part (2*a*) of the leather band (2) in place around the spindle (1).

In the embodiment shown in FIGS. 1–5, the upper portions of the wings (4 and 5) are extended toward the leather strap, then folded back in an inward direction, thus forming the positioning devices (6 and 7).

The distance separating the ends of the positioning devices (6 and 7) is sufficiently large so that, by folding back parallel to its length the part (2*b*) of the leather band forming the strap, the lateral edges of the band may be slid underneath the positioning devices (6 and 7) as shown in FIG. 3.

In this way, the useful length of the leather strap fastened to the buckle may be adjusted as desired, since the two parts (2A and 2*b*) of this strap may, at any position whatsoever, be folded back one over the other around the spindle (1), as may have been in cross section in FIG. 4.

FIG. 5 shows a view in perspective of the device according to the invention, in which the different parts just described and shown in FIGS. 1–4 are shown again.

In FIG. 6, a raised view of a self-extending buckle equipped with a device according to the invention, the device just described is shown in the lower right part of the drawing.

In the case of the embodiment shown in FIG. 6, the support plate (3) is attached to the free end of a piece (8) of the self-extending buckle, which is joined to the other piece (9) by means of a hinge.

The free end of the piece (9) is comprised of a piece (11) which, when the buckle is closed, comes to be positioned above the wings (4 and 5) and the positioning devices (6 and 7), in order to hide them.

The piece (11) also facilitates opening and closing of the self-expanding buckle.

The other piece (12) of the leather strap is hinged to piece (11).

It is evident that, in accordance with the invention, it is possible to adjust, simply and effectively, the length of the leather portion of the strap around the wrist of the user, and this has the advantage of requiring the manufacture and stocking of only a single type of strap.

The device according to the invention also gives the user the advantage of being able to adjust the length of the strap in order to have it conform to possible variations in wrist circumference, which may be done without damaging the leather strap, since the punching of holes is not necessary.

It is understood that the embodiments described above do not limit the invention, and that any desired modifications may be made in these embodiments while still remaining within the invention framework.

It is evident, in particular, that the device according to the invention may be used to attach straps not made of leather, but of another material possessing similar characteristics.

Similarly, it is understood that the positioning devices may be made differently.

I claim:

1. A device for fastening a flexible strap on a buckle, in particular on a self-extending buckle of a wristwatch, said device comprising:

a spindle supported at its extremities by two lateral extensions of a flat support, a space left between said flat support, its extensions, and said spindle being slightly larger than a cross section of said strap;

said lateral extensions supporting lug means with a free space therebetween smaller than said strap,s width;

a length of said strap following a path around said spindle with said length forming a U-shaped profile around said spindle; and said length of s trap with said U-shaped profile having a section adjacent to and a section remote from said lug means, said sections being maintained against each other by engaging said section said adjacent to said lug means with said lug means by deformation of said strap by virtue of said strap's flexibility.

2. Device according to claim 1, wherein said strap is made of leather.

3. A device as in claim 2 wherein the flat support, said lateral extensions, and said lug means comprise a single piece metal plate folded back at a right angle to form said lateral extensions and said lug means being bent toward one another.

4. A device as in claim 1 wherein the flat support, said lateral extensions, and said lug means comprise a single piece metal plate folded back at a right angle to form said lateral extensions and said lug means being bent toward one another.

5. A self-extending buckle for a wristwatch comprising:

a first part having a free end and a second end, a device according to claims 2, 1, 3, or 4 being attached at said free end; and a second part hinged on said second end of said first part, said second part being provided with a free end for covering said device for fastening a strap on a buckle.

* * * * *